US005358392A

United States Patent [19]

Ukai

[11] Patent Number: 5,358,392

[45] Date of Patent: Oct. 25, 1994

[54] HORIZONTAL HERMETIC COMPRESSOR HAVING AN OIL RESERVOIR

[75] Inventor: Tetuzou Ukai, Aichi, Japan

[73] Assignee: Mitsubishi Jukogyo Kabushiki Kaisha, Tokyo, Japan

[21] Appl. No.: 75,784

[22] Filed: Jun. 11, 1993

[30] Foreign Application Priority Data

Jun. 12, 1992 [JP] Japan ..... 4-177756

[51] Int. Cl.[5] ..... F04C 18/04; F04C 29/02; F01M 1/02

[52] U.S. Cl. ..... 418/55.6; 418/88; 418/94; 184/6.16; 184/65

[58] Field of Search ..... 418/55.6, 88, 94, 96; 184/6.16, 6.2, 65; 417/410 D

[56] References Cited

U.S. PATENT DOCUMENTS 5,110,268 5/1992 Sakurai et al. ..... 418/55.6

FOREIGN PATENT DOCUMENTS 2562960 10/1985 France .
50-87512 7/1975 Japan ..... 418/94
58-192993 11/1983 Japan ..... 418/88
61-212689 9/1986 Japan ..... 418/55.6
1237385 9/1989 Japan ..... 418/94
2-27186 1/1990 Japan ..... 418/55.6
2155549 9/1985 United Kingdom .

OTHER PUBLICATIONS

Patent Abstracts of Japan, vol. 8, No. 166, Aug. 2, 1984, JP-A-59 60 092.

Patent Abstracts of Japan, vol. 16, No. 157, Jan. 13, 1992, JP-A-40 08 892.

*Primary Examiner*—John J. Vrablik

*Attorney, Agent, or Firm*—Arnold, White & Durkee

[57] ABSTRACT

The present invention relates to a horizontal hermetic compressor comprising an oil reservoir 9 which is installed in a closed housing to store the lubricating oil discharged from an oil pump 51, and an oil supply pipe which connects an oil supply hole 52 to the oil reservoir 9. The opening of an oil suction pipe 56 of the oil pump 51 is positioned below the upper limit oil level height $H_1$ of the lubricating oil 57 stored at the inner bottom of the closed housing 8.

4 Claims, 2 Drawing Sheets

HORIZONTAL HERMETIC COMPRESSOR HAVING AN OIL RESERVOIR

FIELD OF THE INVENTION AND RELATED ART STATEMENT

FIG. 2 shows a typical conventional horizontal hermetic compressor.

The inside of a closed housing 8 is divided into a high-pressure chamber 44 and a low-pressure chamber 45 by a discharge cover 31. The low-pressure chamber 45 has a scroll-type compression mechanism C and an electric motor M installed at the rear thereof. These two components are connected to each other via a rotating shaft 5 extending in the substantially horizontal direction. The electric motor M consists of a rotor Ma and a stator Mb. The rotor Ma is fixed to the rotating shaft 5, while the stator Mb is fixed to the closed housing 8.

The scroll-type compression mechanism C comprises a fixed scroll 1, a rotary scroll 2, a rotation obstruction mechanism 3, such as Oldham's coupling, which obstructs the rotation of the rotary scroll 2 on its own axis though allowing its revolution, a frame 6, and a front bearing 71 and a rear bearing 72 which journal the rotating shaft 5.

The fixed scroll 1 has an end plate 11 and a spiral wrap 12 erected on the inner surface of the end plate 11. The end plate 11 has a discharge port 13 at its center.

The rotary scroll 2 has an end plate 21 and a spiral wrap 22 erected on the inner surface of the end plate 21. A drive bushing 54 is rotatably inserted via a bearing 73 into a boss 23 erected on the outer surface of the end plate 21. In a bore 55 formed in the drive bushing 54, an eccentric pin 53 extending from the front end of the rotating shaft 5 is rotatably fitted.

The fixed scroll 1 and the rotary scroll 2 are off-centered with each other by a predetermined distance and engaged with each other by shifting 180°, by which a plurality of closed spaces 24 are formed.

An oil pump 51 is installed at the rear end of the rotating shaft 5. The tip end of a suction pipe 56 for the oil pump 51 is immersed in the lubricating oil 57 stored at the inner bottom of the closed housing 8. The discharge port of the oil pump 51 communicates with an oil supply hole 52 formed in the rotating shaft 5.

The operation of the electric motor M drives the rotary scroll 2 via a revolution mechanism comprising the rotating shaft 5, the eccentric pin 53, the drive bushing 54, and the boss 23. The rotary scroll 2 revolves on a circular locus of revolution radius while its rotation on its own axis is obstructed by the rotation obstruction mechanism 3.

By this revolution of the rotary scroll 2, gas enters the low-pressure chamber 45 through a suction pipe 82. This gas passes through a passage 85 and is sucked in the closed space 24 through a suction chamber 43. Then, the gas reaches the central portion while being compressed as the volume of the closed space 24 is decreased by the revolution of the rotary scroll 2. The gas enters a discharge chamber 42 through the discharge port 13 by pushing a check valve 17, and is discharged to the outside through the high-pressure chamber 44 and a discharge pipe 83.

Simultaneously, the oil pump 51 is operated. The oil pump 51 sucks the lubricating oil 57 stored at the inner bottom of the closed housing 8 through the suction pipe 56 and pressurizes it. The lubricating oil discharged from the oil pump 51 passes through the oil supply hole 52 and lubricates the rear bearing 72 and the front bearing 71. Further, the lubricating oil lubricates the eccentric pin 53, the bearing 73, and other parts, and then returns to the bottom of the closed housing 8 through the oil discharge hole 62.

In the above-described horizontal hermetic compressor, when the oil level of the lubricating oil stored at the inner bottom of the closed housing 8 rises and reaches the rotor Ma, the rotor Ma lifts up the lubricating oil, so that a resistance occurs, thereby the power being wasted. The splash of lifted lubricating oil enters the closed space 24 by accompanying the gas sucked in the low-pressure chamber, so that oil loss (the quantity of lubricating oil contained in the discharged gas) is increased.

If the quantity of stored lubricating oil is decreased to solve the above problem, poor lubrication of sliding parts and resulting excessive wear or seizure occur when the oil level of the lubricating oil 57 stored at the inner bottom of the closed housing 8 lowers.

OBJECT AND SUMMARY OF THE INVENTION

An object of the present invention is to provide a horizontal hermetic compressor in which a lift of lubricating oil is prevented when the oil level of the lubricating oil stored at the inner bottom of a closed housing rises, and also poor lubrication of sliding parts in a compression mechanism and rotating shaft is prevented when the oil level of the lubricating oil lowers.

To achieve the above object, the present invention provides a horizontal hermetic compressor in which lubricating oil stored at the inner bottom of horizontal closed housing incorporating a compression mechanism is sucked by an oil pump so as to lubricate sliding parts in the compression mechanism and rotating shaft, which extends substantially in the horizontal direction, through an oil supply hole formed in the rotating shaft, wherein the horizontal hermetic compressor comprises an oil reservoir which is installed in the closed housing to receive the lubricating oil discharged from the oil pump and hold the lubricating oil above the oil supply hole, and an oil supply pipe which connects the oil supply hole to the oil reservoir, the opening of an oil suction pipe of the oil pump being positioned below the upper limit oil level height of lubricating oil stored at the inner bottom of the closed housing.

According to the present invention, which has the above-described constitution, when the oil level of the lubricating oil stored at the inner bottom of the closed housing rises above the opening of the oil suction pipe, the lubricating oil is sucked by the oil pump through the oil suction pipe and stored in the oil reservoir. The lubricating oil stored in the oil reservoir passes through the oil supply hole through the oil supply pipe and is supplied to the sliding parts in the compression mechanism and rotating shaft for lubrication. Therefore, the sliding parts are surely lubricated, and at the same time the oil level of the lubricating oil stored at the inner bottom of the closed housing can be kept below the upper limit oil level height. As a result, poor lubrication of sliding parts can be prevented, and the waste of power can also be prevented. In addition, oil loss can be minimized.

DETAILED DESCRIPTION OF PREFERRED EMBODIMENTS

Figure 1:
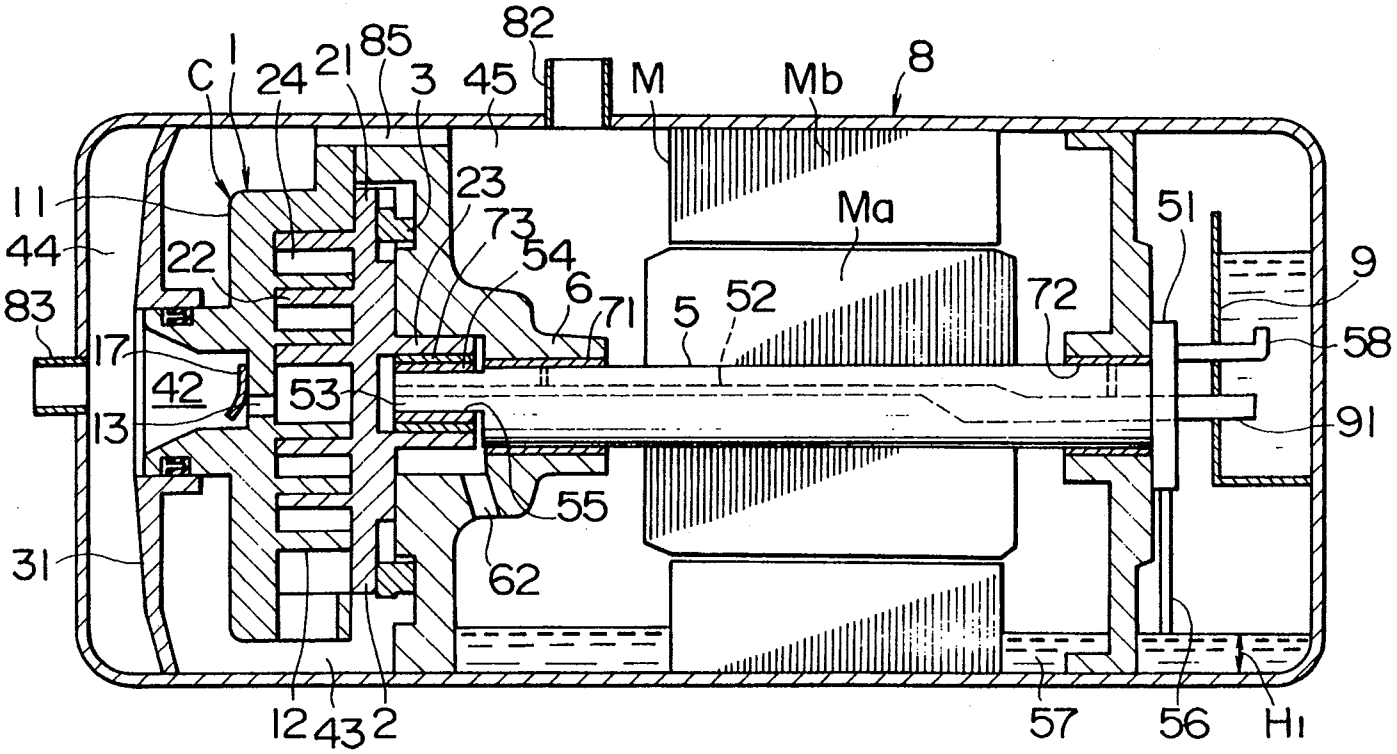
FIG. 1 is a longitudinal sectional view of a horizontal hermetic compressor in accordance with an embodiment of the present invention.

FIG. 1 shows one embodiment of the present invention.

Figure 2:
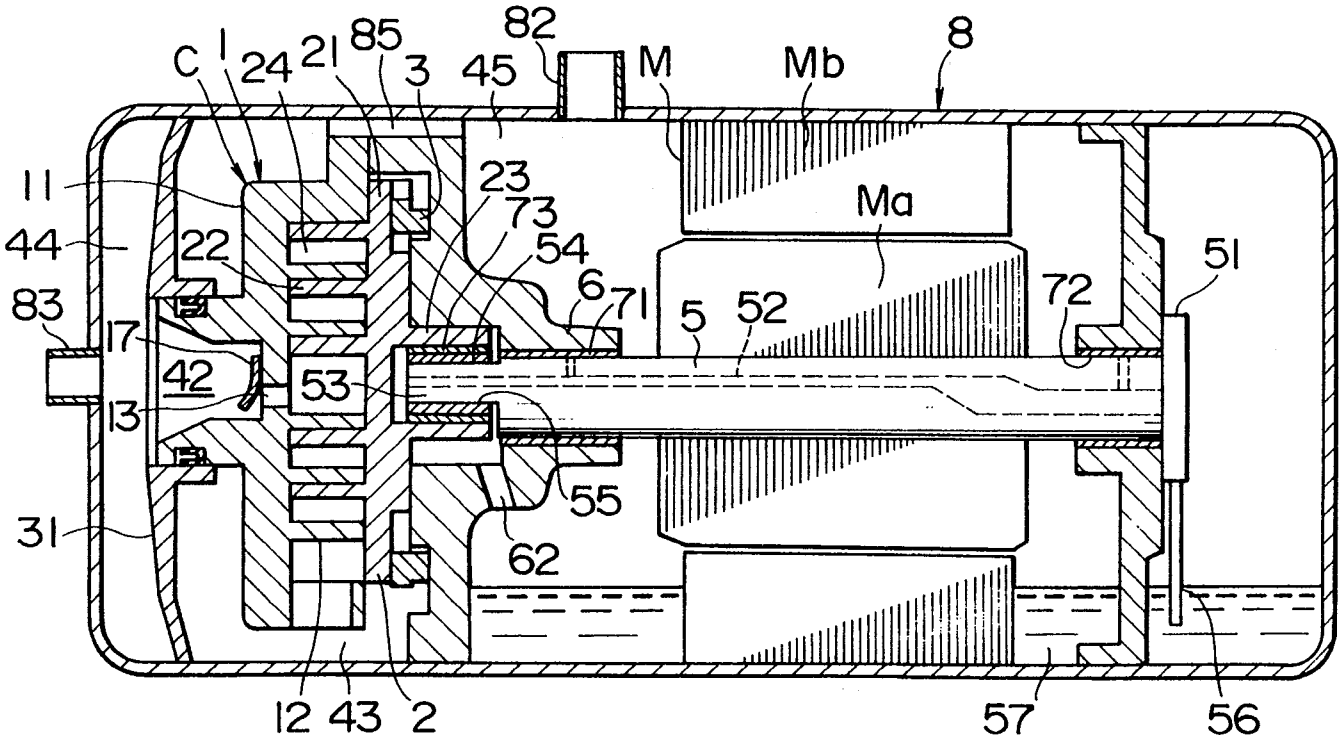
FIG. 2 PRIOR ART
FIG. 2 is a longitudinal sectional view of a horizontal hermetic compressor of prior art.

In FIG. 1, the same reference characters are applied to the elements which are essentially the same as the elements in FIG. 2.

An oil reservoir 9 is disposed in the closed housing 8. This oil reservoir 9 is formed by welding an end plate at the position opposing to the shaft end of the rotating shaft 5 on the inside of the closed housing 8. To this oil reservoir 9, a discharge pipe 58 of the oil pump 51 and an oil supply pipe 91 communicating with the oil supply hole 52 in the rotating shaft 5 are connected. The oil suction pipe 56 of the oil pump 51 extends downward in the closed housing 8. The opening of the suction pipe 56 is positioned at or below the upper limit oil level height $H_1$, which is an allowable limit for avoiding the immersion of rotor Ma in the lubricating oil; in the figure, the opening is positioned at the upper limit oil level height $H_1$.

When the initial volume of lubricating oil in the closed housing is taken as $V_0$, and the volume of stored oil of upper limit oil level height $H_1$ is taken as $V_1$, the volume V of the oil reservoir 9 is set so that the condition of $V \geqq V_0 - V_1$ is satisfied.

If the oil level of the lubricating oil 57 stored at the inner bottom of the closed housing 8 exceeds the upper limit oil level height $H_1$, the lubricating oil 57 is sucked by the oil pump 51 through the oil suction pipe 56, and sent to the oil reservoir 9 through the discharge pipe 58. The lubricating oil in the oil reservoir 9 is supplied to the oil supply hole 52 through the oil supply pipe 91 by the head difference. The oil passes through the oil supply hole 52 and is supplied to the sliding parts such as the rear bearing 72, front bearing 71, eccentric pin 53 and bearing 73.

If the discharge quantity of the oil pump 51 is set so as to be larger than the oil quantity supplied from the oil reservoir 9 to the sliding parts, the oil level of the lubricating oil contained in the oil reservoir 9 can be kept at a sufficiently high level.

Thus, a sufficient quantity of oil can be supplied to the sliding parts, and at the same time the oil level of the lubricating oil 57 at the inner bottom of the closed housing 8 is always kept near the opening of the oil suction pipe 56, that is, at the upper limit oil level height $H_1$. Therefore, the immersion of the rotor Ma of the electric motor M in the lubricating oil 57 can be avoided.

I claim:

1. In a horizontal hermetic scroll compressor having a low pressure housing comprising:

a closed housing;

a scroll compression member and a motor contained in said housing;

a rotary shaft extending horizontally through said housing for transmitting rotation of said motor to said compression mechanism, said rotary shaft having an oil feed hole for feeding a lubricant to said compression mechanism and the sliding surfaces of said rotary shaft;

an oil pump mounted near the end of said rotary shaft;

an oil suction pipe, connected to said oil pump, having an open end, said open end positioned below maximum desired oil level in said housing;

an oil reservoir located inside said closed housing for storing lubricant from said oil pump in a position higher than said oil feed hole; and an oil feed pipe connected to said oil reservoir for supplying lubricant to said oil feed hole.

2. A horizontal hermetic compressor according to claim 1 wherein said oil reservoir is disposed at the position opposing to the shaft end of said rotating shaft on the inside of said closed housing.

3. A horizontal hermetic compressor according to claim 2 wherein said oil reservoir includes an end plate welded to the inside of said closed housing.

4. A horizontal hermetic compressor according to claim 1 wherein when the initial volume of lubricating oil in the closed housing is taken as $V_0$, and the volume of stored oil of upper limit oil level height $H_1$ is taken as $V_1$, the volume V of the oil reservoir is set so that the condition of $V \geqq V_0 - V_1$ is satisfied.

* * * * *